US010984773B2

(12) United States Patent
Glowka

(10) Patent No.: US 10,984,773 B2
(45) Date of Patent: Apr. 20, 2021

(54) ELECTRICALLY AMPLIFIED MARIMBA

(71) Applicant: John Glowka, Jupiter, FL (US)

(72) Inventor: John Glowka, Jupiter, FL (US)

( * ) Notice: Subject to any disclaimer, the term of this patent is extended or adjusted under 35 U.S.C. 154(b) by 0 days.

(21) Appl. No.: 16/836,929

(22) Filed: Apr. 1, 2020

(65) Prior Publication Data

US 2020/0227017 A1 Jul. 16, 2020

Related U.S. Application Data

(63) Continuation-in-part of application No. PCT/US2019/042301, filed on Jul. 17, 2019.

(60) Provisional application No. 62/753,075, filed on Oct. 31, 2018.

(51) Int. Cl.
*G10H 3/14* (2006.01)
*G10D 13/08* (2020.01)

(52) U.S. Cl.
CPC ..... *G10H 3/14* (2013.01); *G10D 13/08* (2013.01); *G10H 2220/461* (2013.01)

(58) Field of Classification Search
CPC ..... G10H 3/14; G10H 2220/461; G10H 2220/521; G10H 2230/255; G10H 3/146; G10H 3/143; G10H 3/22; G10H 3/20; G10H 3/16; G10D 13/08
See application file for complete search history.

(56) References Cited

U.S. PATENT DOCUMENTS 3,542,936 A 11/1970 Babicky
3,633,453 A * 1/1972 Musser ..... G10K 1/10 84/403
3,649,737 A * 3/1972 Jespersen ..... G10H 3/20 84/725
3,684,814 A 8/1972 Neustadt
3,731,580 A * 5/1973 Suzuki ..... G10D 13/08 84/403
4,184,398 A * 1/1980 Siegelman ..... G10H 3/20 335/302
4,356,753 A 11/1982 Galley
4,903,563 A 2/1990 Mizuguchi
6,150,600 A * 11/2000 Buchla ..... G10H 1/0555 84/688
7,732,691 B2 * 6/2010 Stevens ..... G10D 13/08 84/403
8,969,701 B1 * 3/2015 Dixon ..... G10H 3/143 84/726

(Continued)

FOREIGN PATENT DOCUMENTS

GB 976371 A 11/1964
GB 998257 A 7/1965

OTHER PUBLICATIONS

International Search Report from related PCT application.

*Primary Examiner* — Jeffrey Donels
(74) *Attorney, Agent, or Firm* — Allen F. Bennett; Bennett Intellectual Property

(57) ABSTRACT

An electrically amplified percussive instrument has at least one tone bar having a bottom side and fundamental nodes each of the fundamental nodes defined by a channel. A permanent magnet on the bottom side of the tone bar is proximal to one of the fundamental nodes and not aligned with a location of maximum tone bar vibration. A pickup coil positioned underneath the tone bar is aligned with the first permanent magnet and in electrical communication with an amplifier.

16 Claims, 4 Drawing Sheets

(56) References Cited

U.S. PATENT DOCUMENTS

| | | | | |
|---|---|---|---|---|
| 10,692,479 | B2 * | 6/2020 | Abe | G10H 3/143 |
| 10,777,181 | B2 * | 9/2020 | Topel | G10H 3/18 |
| 2010/0037756 | A1 * | 2/2010 | May | G10D 13/08 84/723 |
| 2012/0067197 | A1 * | 3/2012 | May | G10D 13/08 84/723 |
| 2019/0304425 | A1 * | 10/2019 | Topel | G10H 3/26 |

* cited by examiner

ELECTRICALLY AMPLIFIED MARIMBA

CROSS-REFERENCE TO RELATED APPLICATIONS

This application is a continuation-in-part of Application No. PCT/US19/42301 filed on Jul. 17, 2019, which claims priority to U.S. Provisional Application Ser. No. 62/753,075 filed on Oct. 31, 2018, the contents of which are hereby incorporated in their entirety.

TECHNICAL FIELD

The present invention relates to electrically amplified mallet keyboard percussion instruments. More particularly, the invention relates to an electrically amplified mallet keyboard percussion instrument such as a Marimba, xylophone or other instrument having a plurality of tone bars wherein magnets are attached to each of the tone bars near its nodes and electrical pickups.

BACKGROUND ART

The Marimba is one of several types of mallet keyboard percussion instruments. Like the xylophone, it consists of a series of tone bars of different lengths which are struck with a mallet or hammer, resulting in musical tones generated by the vibration of the tone bars. The Marimba typically includes resonating tubes for amplification that extend downward below the tone bars.

With the advent of electrical instruments, attempts have been made to electrically amplify marimbas and similar instruments. Typically, microphones have been placed near the tone bars or within a resonator tube. Generally, microphones are positioned near the center of the tone bar because it is generally accepted that this is the primary source of the sound generated by the instrument. However, using a separate microphone for each tone bar becomes unwieldy and impractical as well as expensive. It is also generally accepted that these designs do not offer a significant advantage over ambient microphones placed about a musical instrument.

An alternative attempt to electrify percussive instruments such as marimbas and xylophones has consisted of replacing the classic wooden tone bars with metal tone bars capable of producing an electronic signal in a magnetic reluctance transducer similar to pickups used in electrical guitars and other stringed instruments. Optionally, wooden tone bars may also have a small sheet of metal attached to them to allow a guitar type pickup transducer to generate an electric signal. However, ferromagnetic tone bars or metal attachments to wooden tone bars have so far been incapable of generating the rich series of overtones characteristic of the preferred, wooden tone bars.

Adding metal plates to tone bars also have failed to produce high quality electrical signals that faithfully replicate the sounds of a typical Marimba with wooden tone bars. Thus, both attempts to electrify marimbas and xylophones, using a microphone or a magnetic reluctance transducer, have thus far failed to adequately amplify a Marimba and a manner that captures the subtle resonances, harmonics and timbre in the array of frequencies that are characteristic of a Marimba. The traditional pick up has physical limitations to pick up over a large area unlike a guitar which is concentrated in a few square inches.

The primary nodes of the tone bar are found at the attachment points connecting the tone bars to the frame of the instrument. During play, the nodes remain substantially and theoretically stationary. Generally, it would be counter-intuitive to place microphones or other transducers near the nodes of a tone bar because they would be ineffective at converting the sounds of the Marimba into electric signals. Tone bars are typically made of wood or other solid material whose amplitudes of vibration are at least an order of magnitude smaller than the relatively large vibrations produced by the strings of a stringed instrument. Thus, it is generally accepted that it's microphones and/or transducers must be placed within the resonant tubes or directly underneath the middle of the tone bar in order to detect vibrations. Unfortunately, this positioning results in the loss of the characteristic sounds of the instrument.

FIG. 1 shows an exaggerated example of the three lowest vibrational modes, 10, 12 and 14, of a tone bar 16 of a marimba having fundamental nodes 18. In each of these modes, the position of the node 18 does not oscillate. Different regions of the tone bar 16 oscillate in varying amounts depending upon the particular mode. Except for the first mode 10, also referred to as the fundamental frequency, every mode of a tone bar has at least additional node where the amplitude is zero. It can be seen that in the first mode 10 and the third mode 14, the center 20 of the tone bar 16 has a maximum amplitude. However, the center 20 of the tone bar 16 is the location of a node of the second mode 12 and therefore exhibits an amplitude of zero for that mode.

When a tone bar 16 is struck, it does not vibrate in only a single mode. Instead, the tone bar has a vibration pattern formed by a superposition of all of the modes as shown in FIG. 2. For simplicity, FIG. 2 only illustrates the superposition of the first three modes 10, 12 and 14. Those skilled in the art will appreciate that there are in fact several more modes that contribute to the overall vibration of a tone bar. The one common feature of these multiple modes is that every one of them remain stationary at their fundamental nodes 18. A sensor located at the middle of a tone bar 16 should detect no signal at all from the even-numbered modes. However, as shown in FIG. 2, the vibrational amplitudes and frequencies overlap at locations 22 near the nodes 18. Therefore, a sensor placed at the position 22 will exhibit a vibration pattern formed from contributions from all of the bar's modes.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide an electrically amplified Marimba using transducers capable of capturing the unique sound qualities and characteristics of a Marimba, idiophone or mallet keyboard percussion instrument with tone bars.

SUMMARY OF INVENTION

Disclosed is an electrically amplified mallet keyboard percussion instrument comprising a plurality of linearly aligned tone bars. Each tone bar has a bottom side and primary, or transverse, nodes at which each of the bars is suspended over a frame. The tone bar vibrates transverse, tortional and lateral. A magnet is attached to the bottom sides of the tone bars, proximal to the nodes. Pickup coils attached to the frame are aligned with the magnets and send an electric signal to an amplifier when the tone bar is struck. The magnets may be permanent or electric. external or embedded.

In one embodiment, an electrically amplified percussive instrument comprises at least one tone bar having a bottom side, a first node and a second node. Each of the fundamental nodes is defined by a channel. A permanent magnet on the bottom side of the tone bar is proximal to the first node and not is aligned with a location of maximum tone bar vibration. A pickup coil is positioned underneath the tone bar and aligned with the permanent magnet. An amplifier is in electrical communication with the pickup coil.

The electrically amplified percussive instrument optionally includes a back bias magnet underneath the pickup coil. The electrically amplified percussive instrument also optionally includes a second permanent magnet located on the bottom side of the tone bar proximal to the second node and a second pickup coil positioned underneath the at least one tone bar and aligned with the second permanent magnet. The electrically amplified percussive instrument optionally includes a supporting cord passing through the channels of the nodes, suspending the at least one tone bar above a frame. The permanent magnet is optionally located between the first node and a distal end of the tone bar. The percussive instrument also optionally includes a magnet located medial to the first node. The permanent magnet is optionally located inside a cavity in the bottom side of the tone bar. A plurality of pickup coils are optionally linearly arranged along a ribbon mounted on the marimba frame.

It is therefore an object of the present invention to provide an electrically amplified marimba having improved sound quality and effective amplification in large audience and stage environments.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF DRAWINGS

A more complete understanding of the present invention, and the attendant advantages and features thereof, will be more readily understood by reference to the following detailed description when considered in conjunction with the accompanying drawings wherein.

DESCRIPTION OF EMBODIMENTS

Figure 1:
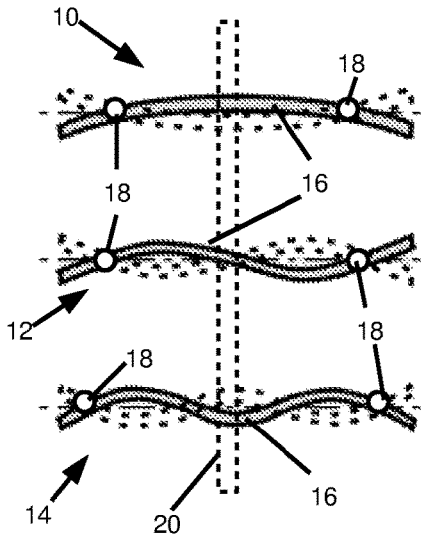
FIG. 1 is a diagram of different vibrational modes of a tone bar of a percussive musical instrument in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. In addition, the terms "nodes," "modes," "frequency," "extremum" "maximum" and "superposition" used herein have their mathematical meanings as used in reference to standing waves. Throughout the drawings, the various components shown are not necessarily drawn to scale and are intended to be representations only, highlighting and identifying the features of a percussive instrument, e.g. a marimba, in accordance with the principles of the invention. A point, position or location "of maximum vibration" refers to an anti-node, that is an area of the tone bar having an amplitude of vibration that is a local extremum. From a musical perspective, modes represent the various overtones. The "fundamental frequency" is the lowest mode of a tone bar, and the "fundamental nodes" refer to the stationary points of the fundamental frequency. They also correspond to the points where a tone bar is suspended by either cables or pins.

Disclosed is an electrically amplified Marimba that captures the tonal qualities of the musical instrument. While the invention is described herein primarily in relation to a Marimba, those skilled in the art will appreciate that the invention may also be utilized with other mallet keyboard percussive instruments. An electrically amplified marimba in accordance with principles of the invention includes a permanent magnet incorporated into each tone bar at or near one or both of its nodes, and not in proximity to the locations on the tone bar exhibiting maximum vibration. A pickup similar to pickups used for stringed instruments having a magnetic or paramagnetic core surrounded by an electric coil is placed directly underneath the magnet. When a tone bar is struck, the changes in the local magnetic field around the pickup caused by the movements of the permanent magnet within the tone bar alter the current within the pickup. The change in the current produces an electric signal that is then amplified to produce an audio signal. Because of the location of the magnets in the tone bar, all of the different modes and their amplitudes contribute to the electric signal detected by the pickup. The electric signal produced by the pickup thus faithfully represents the sound of the marimba, including the superimposed overtones of the tone bars.

Figure 3:
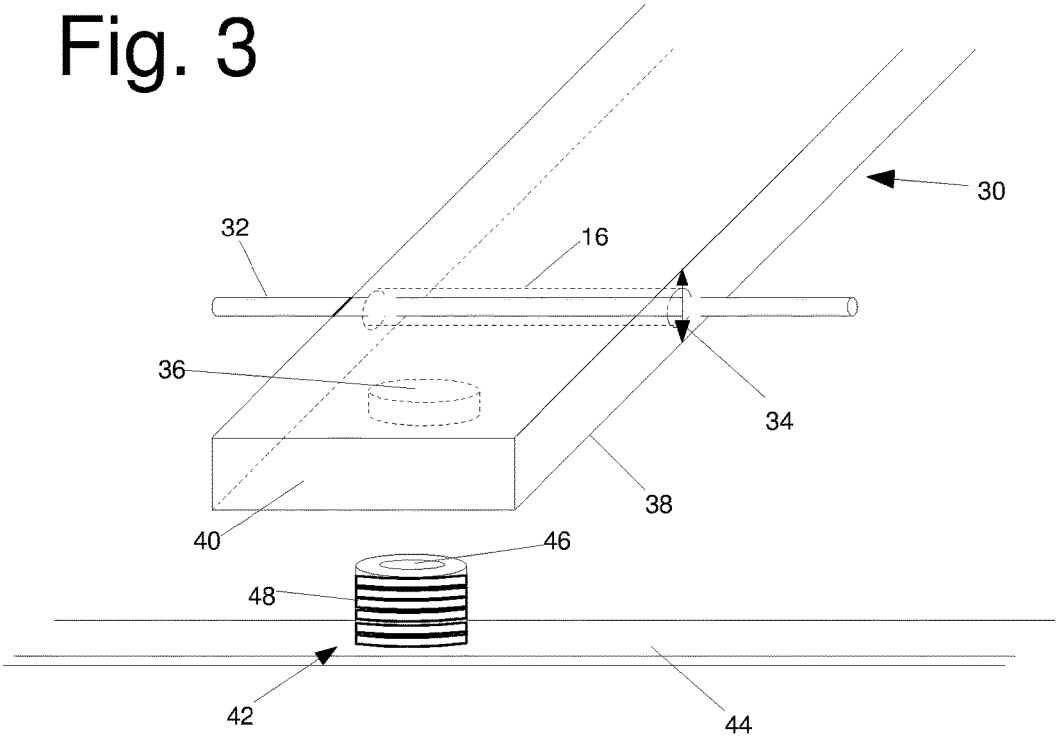
FIG. 3 is a perspective view of a tone bar of a percussive musical instrument in accordance with the principles of the invention.

FIG. 3 shows one end of a marimba tone bar 30 in accordance with the principles of the invention. The tone bar 30 is suspended by a cord 32. Tone bar 30 is made of wood or plastic, and preferably made of Rosewood. Generally, the tone bar 30 is not formed from a ferromagnetic material, but could be made of nonmagnetic metals such as aluminum. The cord 32 extends through a channel 16 through the tone bar 30 located at a fundamental node 34 which, as explained above, does not oscillate significantly vertically regardless of the vibrational mode. A magnet 36 is embedded in the bottom side 38 of the tone bar 30. In this embodiment, the magnet 36 is embedded proximal to the fundamental node 34 between the fundamental node 34 and a distal end 40 of the tone bar 30. A pickup coil 42 is attached to an elongate ribbon 44 which is placed over the top of or integrated with the marimba's key support rail of its frame so that it is directly underneath and in close proximity to the magnet 36. When the tone bar 30 is struck, the magnet 36 oscillates in a pattern formed by the superpositioning of the several modes, or overtones, of the tone bar 30. The overall amplitude of the magnet's 36 oscillations is relatively small and would not be precisely or accurately detected if only a metallic plate were used instead of a magnet. However, a vibrating magnet creates a substantially greater disturbance in the local electromagnetic field that is capable of being accurately detected and generating an electric signal substantially faithful to the true sound generated by the tone bar 30, including more subtle aspects of pitch and timbre.

The magnet 36 is preferably located closer to the fundamental node 34 than the distal end 40 and in general should not be further from the fundamental node 34 than a point halfway between the node 34 and the distal end 40. The distal end 40 is a local maximum of vibration of the tone bar 30 and therefore not suitable for accurately detecting the resonances of the several modes of the tone bar 30. The pickup coil 42 is aligned vertically with the magnet 36 and placed as close as is practical to the bottom side 38 of the tone bar 30. Because the magnet 36 is not located at a point of maximum vibration, the pickup coil 42 may be positioned closer to the tone bar than a pickup at a local vibrational maximum. The oscillation pattern of the magnet depends on the frequencies of all of the modes, or overtones, of the tone bar 30. An electrically amplified marimba in accordance with the principles of the invention also includes various electrical components to filter, equalize and otherwise manipulate the electrical signals received from the pickup coils. As these devices are well known in the art, they have not been described in detail here. The pickup coil 42 of this embodiment includes a ferrite core 46 surrounded by a coil 48. Those skilled in the art will appreciate that this is a non-typical type of coil used for a pickup in the amplification of musical instruments.

Figure 2:
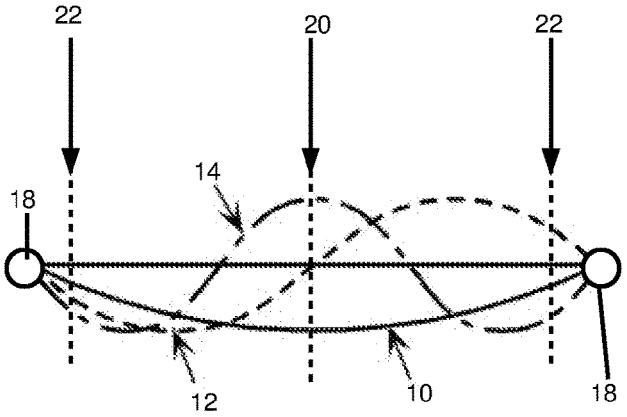
FIG. 2 is a diagram of a superposition of different vibrational modes side of a tone bar of a percussive musical instrument in accordance with the principles of the invention.

Percussive instruments using tone bars, such as xylophones and marimbas, typically include a plurality of tone bars arranged side-by-side and covering at least one, usually several, octaves. Thus, the components of an electrically amplified tone bar in accordance with the principles of the invention are repeated in a linear arrangement to provide a complete percussive instrument. FIG. 2 shows such an arrangement where tone bar 30 is part of a side-by-side series of tone bars 30, each having a different length, thus producing a different tone, but otherwise being identical. The tone bars 30 are supported by a cord 32 over a frame 46, having a ribbon 44 placed along the top of the frame 46 such that the pickup coils 42 are aligned with each of the magnets 36. In this embodiment, the magnets 36 have been embedded inside cavities in the bottom side of the tone bars 30 such that they are flush with the bottom side 38. Because both xylophones and marimbas come in different sizes, having different numbers of tone bars, it may be desirable to provide a ribbon 44 having a number of pickup coils 42 suitable for use with a marimba or xylophone having a six tone bars, or multiples of six. Optionally, the ribbon 44 may include sufficient pickup coils to cover an octave. Two or more of such ribbons can be combined for use on a xylophone or marimba having any multiple of six, or any number of octaves, respectively.

Figure 4:
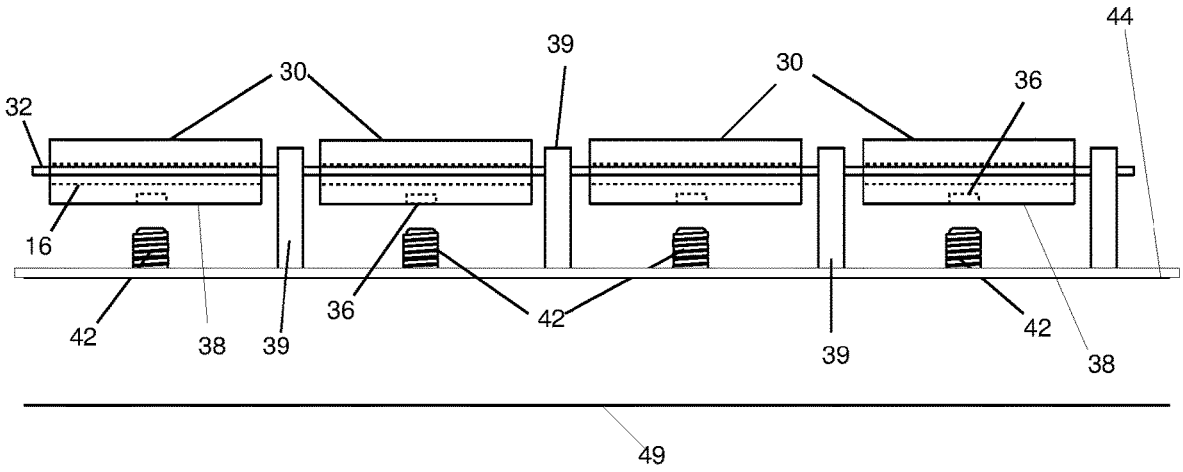
FIG. 4 is a side elevation view of a plurality of side-by-side tone bars of a percussive musical instrument in accordance with principles of the invention.

FIG. 4 shows a side view of a plurality of tone bars 30 each having magnets 36 and pickups 42 arranged along a ribbon 44 such that the pickups 42 are aligned with the magnets 36. The tone bars 30 have different lengths in order to provide different tones but are otherwise identical. The ribbon 44 rests upon a frame 49 of a marimba. FIG. 4 also shows the braces 39 located between adjacent tone bars 30 and support the cord 32.

Figure 5:
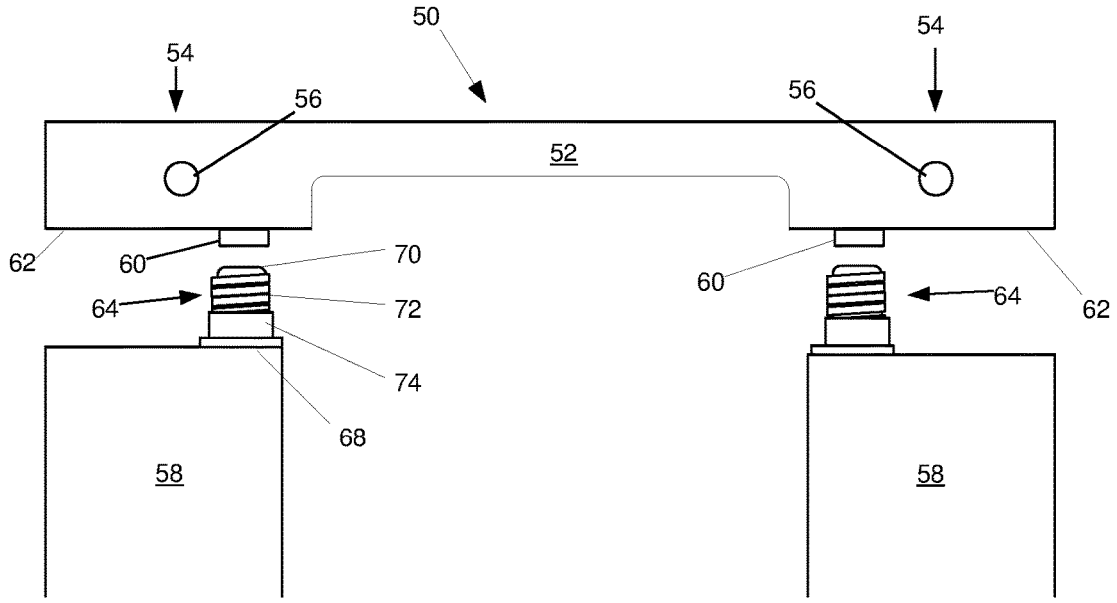
FIG. 5 is a front plan view of an alternative embodiment of a percussive musical instrument in accordance with principles of the invention.

FIG. 5 shows an alternative embodiment of an electrically amplified tone bar 50 in accordance with the principles of the invention. The tone bar 50 includes a thin central region 52 commonly found in tone bar designs and which serves to generally increase the amplitude of the vibrations of the tone bar 50. The tone bar 50 has two fundamental nodes 54 defined by pockets 56. Pins 57 extend upward from the key rail supports 58 and into the pockets 56 to support the tone bars 50. The pins 57 include a head 59 former from an elastomeric material, such as rubber, to reduce or prevent dampening of the tone bars vibrations. The pockets 56 may also include padding, also to prevent dampening the tone bar 50. Magnets 60 have been affixed to the bottom side 62 of the tone bar 50 in a location proximal and medial to the nodes 54. That is, the magnets 60 are positioned between the nodes 54 and the central region 52. In this embodiment, the magnets 60 have been affixed directly to the bottom side 62 of the tone bar 50, and are not placed within a cavity in the tone bar itself. Because the magnets 60 are proximal to the nodes 54 and not in a region of maximal vibration, i.e. an anti-node, they oscillate in a pattern formed by the superposition of the several modes, or overtones, of the tone bar 50. The embodiment shown in FIG. 5 includes two magnets 60 on each tone bar 50 as opposed to the embodiment shown in FIG. 3 having only a single magnet 36 incorporated into a tone bar 30. Generally, the use of two magnets rather than one on each tone bar provides a stronger signal. However, only a single magnet per tone bar is adequate to operate in accordance with the principles of the invention.

Figure 6:
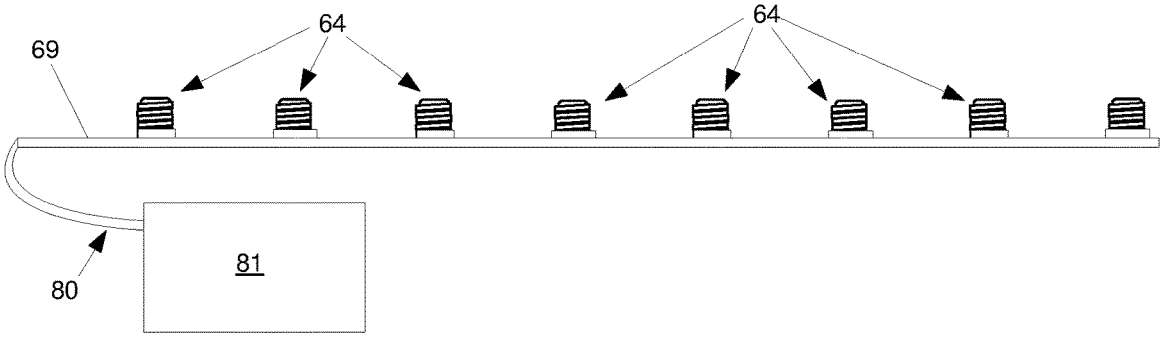
FIG. 6 is a side elevation view of a ribbon having a plurality of pickup coils and in electrical communication with an amplifier.

The pickup coils 64 shown in FIG. 5 are attached to an elongate ribbon 68 which may be placed along the top of the frame 58 of a marimba or xylophone. It is relatively straightforward to affix the magnets 60 to the bottoms 62 of tone bars 50 and to align the pickup coils 64 on the ribbon 68 underneath the magnets 60 on an existing xylophone or marimba. Thus, existing percussive instruments may be retrofitted with these devices to convert them into electrically amplified instruments. A single octave ribbon 69 having eight pickup coils 64, and wires 80 for electrical communication with an amplifier 81 and/or other electronic equipment, is shown in FIG. 6. The pickup coils 64 of this embodiment have a central ferrite core 70 surrounded by a wire wrapped electric coil 72. In addition, each of the pickup coils 64 includes a back bias magnet 74. The back bias magnet 74 may be either a permanent magnet or an electromagnet. Using a back bias magnet stabilizes the local electromagnetic field, thereby increasing the sensitivity of the pickup coil 64. Combining the use of a back bias magnet 74 with the use of a magnet 60, instead of a metal plate or a ferromagnetic tone bar, improves the quality of the electric signal produced by the pickup coil 64 when the tone bar 50 is struck. The back bias magnet counteracts the attraction of the key magnet to the ferrite coil because it has an opposite polarity. This also prevents dampening of the tone bar, or "drag" on the tone bar, which can affect frequency of vibration.

Figure 7:
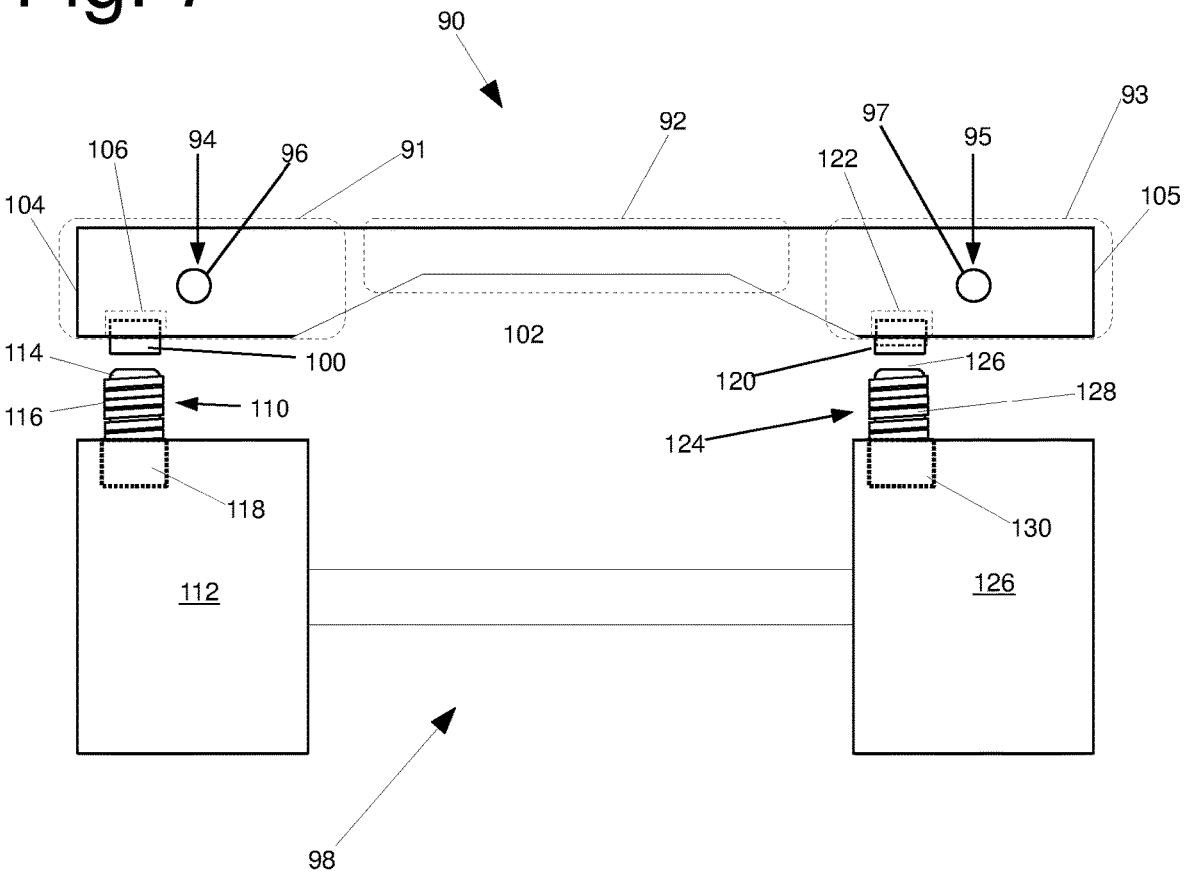
FIG. 7 is a front plan view of an alternative embodiment of a percussive musical instrument in accordance with principles of the invention.
Figure 8:
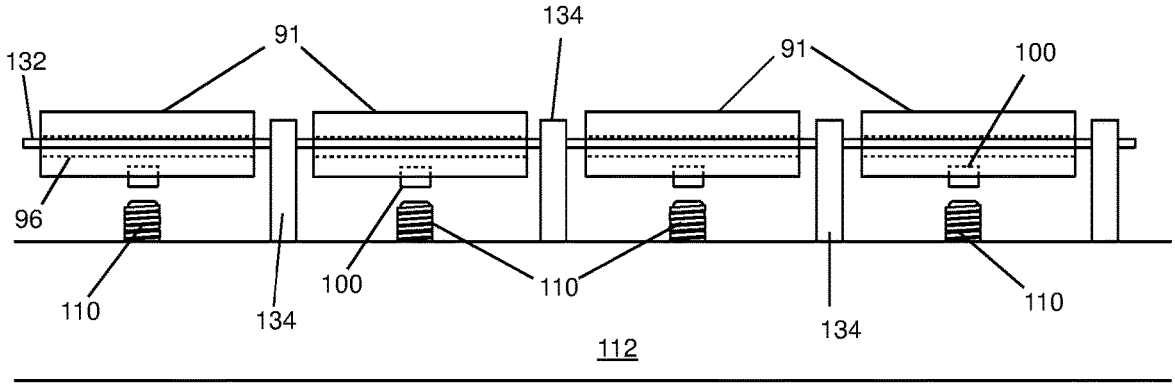
FIG. 8 is a side elevation view of a plurality of side-by-side tone bars of a percussive musical instrument in accordance with principles of the invention.

FIG. 7 shows another alternative embodiment of an electrically amplified tone bar 90 for use in an electrically amplified percussive instrument in accordance with the principles of the invention. The tone bar 90 has a thin central region 92 that allows the tone bar 90 to exhibit increased vibrational amplitudes. The thin central region 92 is situated between first and second lateral regions 91 and 93, respectively, which are substantially thicker. The tone bar 90 also includes a first fundamental node 94 and a second fundamental node 95, defined by channels 96 and 97, respectively, for accommodating supporting cords, not shown, that hold the tone bar 90 above a frame 98. A first magnet 100 on the bottom side 102 of the tone bar 90 is positioned approximately halfway between the first fundamental node 94 and a first distal end 104. The first magnet 100 is situated partially within a cavity 106 in the bottom side 102 of the tone bar 90, and also partially protrudes downward from the bottom side 102. FIG. 8 shows a side view of the first lateral region 91 of several tone bars arranged side-by-side. A cord 132 traveling through the channels 96 is supported by a series of braces 134 located between adjacent tone bars.

In this embodiment, a first pickup coil 110 is incorporated into a first side 112 of the frame 98. The first pickup coil 110 includes a ferrite core 114, a coil 116 and a back bias magnet 118. The first pickup coil 110 extends upward from the first side 112 of the frame 98 but is also partially housed inside the first side 112 of the frame 98. The extent to which the first pickup coil 110 extends upward may be adjustable in order to reduce the distance between the first magnet 100 and the first pickup coil 110. Similarly, the first magnet 100 may also be vertically adjustable so that it may be moved downward in order to be closer to the first pickup coil 110. The first magnet 100 may be permanently fixed in the tone bar 90 or may be removable. The pickups may also optionally be encased in an epoxy or electrical potting compound.

The embodiments shown in FIG. 7 also includes a second permanent magnet 120 on the bottom side 102 of the tone bar 90, located in the second lateral region 93 of the tone bar 90. The second permanent magnet 120 is positioned between the second fundamental node 95 and the central region 92 such that it is medial to the node 95. The second permanent magnet 120 is therefore further away from a second distal end 105 than the second fundamental node 95. The second permanent magnet 120 is housed within a cavity 122 and partially extends downward out of the cavity 122. Because the second permanent magnet 120 is positioned near the node 95 and is not in a region of maximum vibration or proximal to an anti-node. A second pickup coil 124 is incorporated into a second side 126 of the frame 98. The second pickup coil 124 has a central ferrite core 126, a coil 128 around the core 126 and a back bias magnet 130. The second pickup coil 124 is vertically aligned with the second permanent magnet 120. The embodiment shown in FIG. 7 has a first magnet and pickup positioned distally relative to one node and a second magnet and pickup positioned medially to a second node. This arrangement may allow the pickup coils to detect subtly different electric signals due to subtly different vibration patterns of the two magnets due to their different locations relative to their respective nodes. FIG. 8 shows a side view of the first lateral region 91 of several tone bars arranged side-by-side. A chord 132 traveling through the channels 96 is supported by a series of braces 134 located between adjacent tone bars.

Figure 9:
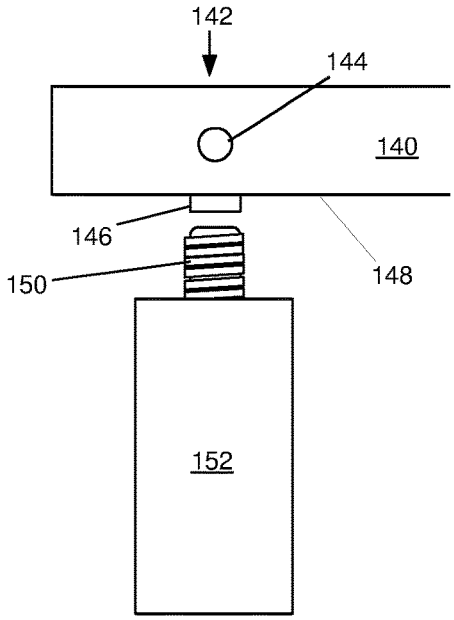
FIG. 9 is a front plan view of another alternative embodiment of a percussive musical instrument in accordance with principles of the invention.

FIG. 9 shows another alternative embodiment of an electrically amplified tone bar 140 of an electrically amplified marimba. The tone bar 140 has a fundamental node 142 defined by a channel 144 for accommodating a supporting cord, not shown. A magnet 146 is attached to the bottom side 148 of the tone bar 140. A pickup coil 150, which is incorporated into the frame 152, is underneath and vertically aligned with the magnet 146. In this embodiment, the magnet 146 is vertically aligned with the node 142. A magnet aligned with the node will "wobble" thereby creating a more subtle variation in the local magnetic field. The wobbling behavior of such a magnet may be more difficult to detect, but still generates a sufficient signal for amplification.

Figure 10:
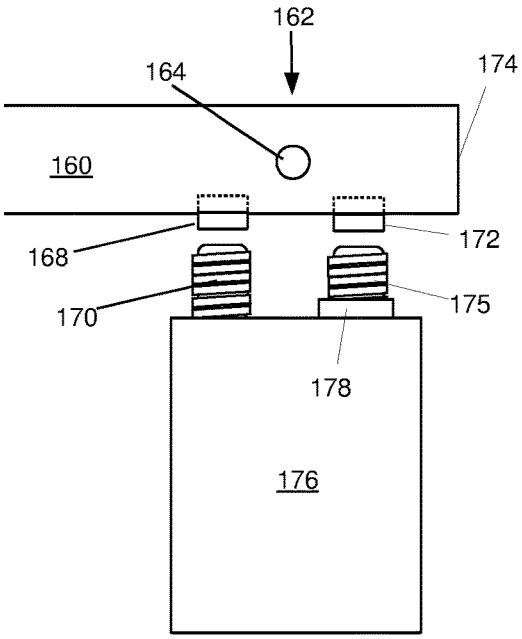
FIG. 10 is a front plan view of another alternative embodiment of a percussive musical instrument in accordance with principles of the invention.

FIG. 10 shows another alternative embodiment of an electrically amplified tone bar 160 in accordance with the principles of the invention. The tone bar 160 has a node 162 defined by a pocket 164 that accommodates a supporting pin 165 having a rubber head. A medial magnet 168 is at a location medial to the node 162. A medial pickup coil 170 is vertically aligned with the medial magnet 168. The tone bar 160 also has a distal magnet 172 positioned between the node 162 and a distal end 174. The distal magnet 172 is closer to the node 162 than the distal end 174. A distal pickup coil 175 is vertically aligned with the distal magnet 168. The medial pickup coil 170 is incorporated into the frame 176. The distal pickup coil 174 is attached to a ribbon 178 placed on top of the frame 176. The magnetic fields of the medial pickup coil 170 and distal pickup coil 175 are aligned in opposite directions.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated. Those skilled in the art will appreciate that the conception, upon which this disclosure is based, may readily be utilized as a basis for the designing of other structures, methods and systems for practicing the present invention. It is important, therefore, that the claims be regarded as including such equivalent constructions insofar as they do not depart from the spirit and scope of the present invention.

The invention claimed is:

1. An electrically amplified percussive instrument comprising:

at least one tone bar having a bottom side, a first fundamental node and a second fundamental node;

a first permanent magnet on the bottom side of the at least one tone bar proximal to the first fundamental node and not aligned with a location of maximum tone bar vibration;

at least one first pickup coil positioned underneath the at least one tone bar and aligned with the first permanent magnet; and, an amplifier in electrical communication with the at least one first pickup coil.

2. The electrically amplified percussive instrument of claim 1 further comprising a first back bias magnet underneath the first pickup coil and having a polarity opposite to the first permanent magnet.

3. The electrically amplified percussive instrument of claim 1 further comprising:

a second permanent magnet located on the bottom side of the at least one tone bar proximal to the second fundamental node; and, a second pickup coil positioned underneath the at least one tone bar and aligned with the second permanent magnet, wherein the second pickup coil is in electrical communication with the amplifier.

4. The electrically amplified percussive instrument of claim 3 further comprising a first supporting cord passing through a channel of the first fundamental node and a second supporting cord passing through a channel of the second fundamental node, the first and second supporting cords suspending the at least one tone bar above a frame.

5. The electrically amplified percussive instrument of claim 1 wherein the electrically amplified percussive instrument is a marimba.

6. The electrically amplified percussive instrument of claim 1 wherein the at least one tone bar comprises a plurality of tone bars and the at least one first pickup coil comprises a plurality of first pickup coils.

7. The electrically amplified percussive instrument of claim 1 wherein the first permanent magnet is located between the first fundamental node and a first distal end of the at least one tone bar.

8. The electrically amplified percussive instrument of claim 1 wherein the first permanent magnet is located medial to the first fundamental node.

9. The electrically amplified percussive instrument of claim 1 wherein the at least one tone bar is a wooden tone bar.

10. The electrically amplified percussive instrument of claim 1 wherein the first permanent magnet is located inside a cavity in the bottom side of the at least one tone bar.

11. The electrically amplified percussive instrument of claim 1 wherein the first permanent magnet is attached to the bottom side of the at least one tone bar.

12. The electrically amplified percussive instrument of claim 1 wherein the plurality of pickup coils are linearly arranged along at least one ribbon mounted on a frame.

13. The electrically amplified percussive instrument of claim 1 wherein the plurality of pickup coils are linearly arranged along a plurality of linearly arranged ribbons mounted on a frame.

14. The electrically amplified percussive instrument of claim 1 wherein the first permanent magnet is located at the first fundamental node.

15. An electrically amplified percussive instrument comprising:

at least one tone bar having a bottom side, a first fundamental node and a second fundamental node;

a first permanent magnet on the bottom side of the at least one tone bar proximal to the first fundamental node and not aligned with a location of maximum tone bar vibration;

at least one first pickup coil positioned underneath the at least one tone bar and aligned with the first permanent magnet;

a first back bias magnet underneath the at least one first pickup coil; and, an amplifier in electrical communication with the at least one first pickup coil;

wherein the plurality of pickup coils are linearly arranged along at least one ribbon mounted on the frame.

16. The electrically amplified percussive instrument of claim 15 wherein:

the at least one tone bars comprises a plurality of tone bars; and, the at least one first pickup coil comprises a plurality of first pickup coils.

* * * * *